United States Patent [19]

Verhoeven

[11] Patent Number: 4,701,001

[45] Date of Patent: Oct. 20, 1987

[54] CONNECTOR FOR A COAXIAL CABLE

[75] Inventor: Laurentius M. Verhoeven, Veghel, Netherlands

[73] Assignee: E. I. Du Pont de Nemours and Company, Wilmington, Del.

[21] Appl. No.: 942,187

[22] Filed: Dec. 16, 1986

[30] Foreign Application Priority Data

Dec. 23, 1985 [NL] Netherlands ..... 8503553
Jan. 10, 1986 [NL] Netherlands ..... 8600041

[51] Int. Cl.[4] ..... H01R 4/24

[52] U.S. Cl. ..... 439/394; 439/63; 439/581

[58] Field of Search ..... 339/17 C, 97 R, 97 P, 339/98, 99 R, 177

[56] References Cited

U.S. PATENT DOCUMENTS

| | | | |
|---|---|---|---|
| 3,804,971 | 4/1974 | Bazille, Jr. | 174/88 |
| 3,985,416 | 10/1976 | Dola et al. | 339/98 |
| 4,033,661 | 7/1977 | Moody et al. | 339/98 |
| 4,405,193 | 9/1983 | Weidler | 339/99 |
| 4,533,197 | 8/1985 | Prince et al. | 339/97 R |
| 4,533,199 | 8/1985 | Feldberg | 339/99 |

FOREIGN PATENT DOCUMENTS

| | | |
|---|---|---|
| 0101290 | 9/1983 | European Pat. Off. . |
| 3108931 | 3/1982 | Fed. Rep. of Germany . |
| 2002599 | 8/1978 | United Kingdom . |
| 2005487 | 9/1978 | United Kingdom . |

*Primary Examiner*—Joseph H. McGlynn

[57] ABSTRACT

A connector for a coaxial cable comprising a cap and a bottom insulating plate. The plate has mounted thereon a first and second pair of contact elements. After the end of the cable is properly prepared, the first pair of contact elements is designed to pierce the outer insulation sheath of the cable and electrically contact the outer conductor while the second pair of contact elements is designed to pierce the inner insulation sheath and contact the inner conductor. The cap has inner slots and spaces adapted to receive the contact elements and portions of the cable end so that when the cap is pressed down and latched to the bottom plate, electrical contact is made with the inner and outer conductors and all portions of the inserted cable end are properly supported, thus ensuring adequate strain-relief.

9 Claims, 9 Drawing Figures

CONNECTOR FOR A COAXIAL CABLE

BACKGROUND OF THE INVENTION

1. Field of the Invention

This invention relates to an electrical connector and, in particular, to an electrical connector for a coaxial cable.

2. Description of Related Art

Coaxial cable connectors often terminate the cable by insulation displacement contacts. U.S. Pat. Nos. 4,533,193 and 4,533,199, both issued Aug. 6, 1985, describe such connectors for interconnecting coaxial cable with a printed circuit board.

These connectors include a base member of insulating material on which are mounted insulation displacement contact elements. The contact elements comprise pins at one end which project downwards through the base member for the insertion in the holes of a printed circuit board. At the other end are slots. The slot of one contact element is wider than the other since it penetrates through the outer insulation sheath of the cable and electrical contacts the outer conductor. The slot of the other contact element is narrower and it penetrates the inner insulator to contact the inner conductor. The connector also includes a hinged cover member which is closed over the contact-element on the base member and can be latched therewith.

Single-screened coaxial cables are generally constructed concentrically from a clyindrical inner conductor of electrically conducting material. The inner conductor is surrounded by a cylindrical inner sheath of insulating material and a screen-like cylindrical outer conductor of electrically conducting material disposed around the inner sheath. The outer conductor is usually surrounded by an outer sheath of insulating material. The inner conductor may comprise a solid wire or a plurality of wires such as twisted wires of thinner diameter. The outer conductor may be formed as a woven wire screen, a wrapped-round metal foil or a combination of the two. In multiple screened cable, in place of an inner conductor, two or more inner conductors provided with an insulation sheath are also used. Coaxial cables with a woven screen as outer conductor and a solid inner conductor are in practice the most commonly used.

Cables of this type are typically manually connected to, for example, a printed circuit board by removing the outer sheath at the cable end over a length around the outer conductor. The outer conductor is removed over a shorter length around the inner sheath. Finally, the inner sheath is removed over a still shorter length around the inner conductor. This is a fairly labor-intensive and consequently time-consuming task which greatly risks damage to the cable and which provides no benefit to the quality of the cable or to the reliability of the connection.

If the outer conductor of a coaxial cable is removed over too great a length with respect to the inner conductor, a serious mismatch in the impedance of the cable may arise which may cause a disturbance of the electrical signal to be sent over the cable.

As shown by the aforenoted U.S. Pat. Nos. 4,533,193 and 4,533,199, a relatively rapid connection of one or more coaxial cables to a printed circuit board is possible. It is necessary, however, before the cable is placed in the connector, to first remove the outer sheath and the outer conductor over the same length of the cable end, during which process the inner sheath should remain around the inner conductor. The cable prepared in this manner is then placed on the IDC or slotted ends of the contact elements which cut through the respective insulating sheaths. Afterwards, the connector is closed by lowering the cover pivotably hinged to the bottom member. The cover is provided with various socalled anvils projecting inwards which, as the cover is closed, are pressed onto the assembled cables and hold the latter in the assembled position.

This type of coaxial connector has a number of disadvantages. The cable is initially held in position only by the slotted ends of the contacts. When the cover is swung downwards, the anvils press on portions of the cable end, one on the outer sheath, one on the inner sheath, and one on the bare conductor. These parts may bend during this process in a manner such that incorrect compressive and tensile stresses are exerted on the coaxial cable. Consequently, in the preparation of the cable, close attention must be paid to see that the remaining parts of the cable are not damaged, in particular, the inner sheath, since the bending caused by the pressure of the anvils may cause electrical contact between the inner conductor and the woven outer conductor.

Furthermore, the above described connector does not have strain-relief means to prevent the connections from coming loose when a tension force is exerted in the longitudinal direction of the assembled cable; that is, in the direction of the contact elements positioned behind each other and to prevent, for example, the inner conductor from making electrical contact with the contact element for the outer.

Also, this type of connector has no means for visually inspecting from the outside the cable in its final position with the cover closed. As noted above, the compressive forces in the cable caused by the closing of the cover may lead to breaks in the connection. The absence of such a window is a great disadvantage, especially in the case of assembly on an extensive scale, because inspection of the connection in the final state can be performed only by means of measuring equipment.

It is furthermore known that, as a result of the mechanical construction of the cable, large forces may in practice often arise on the IDC contacts as used in the aforenoted connectors which do not contribute to maintaining a reliable electrical connection to the outer conductor of the coaxial cable.

SUMMARY OF THE INVENTION

In view of the disadvantages described above, the object of the present invention is to provide a connector for connecting a screen cable such as a coaxial cable to, for example, a printed circuit board. Rapid assembly is provided and reliable connections more readily ensured in the final state by a connection which can absorb fairly large forces in the longitudinal direction of the cable without leading to breaks in the connection.

The connector according to the invention has a cap which is provided with specially shaped spaces which, starting from the cable insertion end at one side, are situated behind each other in the insertion direction of the cable and have internal dimensions decreasing from the insertion opening for receiving and at least partially supporting an end of the cable prepared according to a suitable stripping technique. The cap is further provided with lead-throughs or slots in which the IDC or push-on ends of the contacts extend into when the cap is pressed onto the bottom plate. These slots pass through some of the above spaces so that the push-on contacts can penetrate into these spaces.

In the connector according to the present invention, the coaxial cable is supported on all sides by the closely matching spaces in the cap. The internal dimensions of the spaces correspond to the various external dimensions of the sections of the stripped cable. These cable sections are therefore much better supported. In particular, if the insertion opening is matched to the outer diameter of the cable, fairly large tensile forces can be absorbed. Under these conditions, the IDC or push-on ends of the contacts may be located in slots in the housing which extend transversely to the insertion direction of the cable. As a result, the contacts can absorb even larger forces if the cable is pulled in the longitudinal direction.

In a preferred embodiment of the invention, the space for receiving the outer sheath of the coaxial cable is open on the side facing the bottom plate. The bottom plate is provided with an upright part which fits in a sliding manner into this open side and has an upper surface matched to the outer diameter of the cable. This upright part has a length such that after the cap is locked onto the bottom plate, a space is produced which will support the outer sheath of the cable on all sides.

In this connection, the projecting part which fits into the open side of the first space can be provided with dimensions such that a stronger clamping force is exerted on the outer sheath of the cable after the cap is placed on the cover and locked.

The cap is also preferably provided with at least one window which opens at least a portion of the spaces in the cap to the outside. The position and the shape of the stripped cable end can be seen through this window after the cable end is slid into the cap, the cap has been locked on the bottom plate and the various parts have been clamped between the push-on contacts.

Furthermore, the bottom plate is preferably provided with two resilient locking lugs which, situated opposite each other, project upwards from respective side edges of the bottom plate. The free upper ends of the lugs are provided with protuberances facing inwards, while the cap is provided with faces situated behind each other on the side edges where the locking lugs are located and behind which the inwards projecting protuberances can sequentially engage as the cap is pushed onto the bottom plate.

The projecting part of at least the first contact element is preferably constructed as a double push-on contact with parallel contact elements shaped like fork-like teeth. These teeth, when viewed in the insertion direction, are sequentially provided with a sharp transverse knife-like edge at the top of each tooth for cutting into the external insulation sheath, a sloping cutting face for the further cutting through of the insulation sheath and a flat surface, parallel to the insertion direction of the cable which makes contact with the bare conductor so that a stepwise cutting through of the cable insulation is obtained.

The bottom plate and the cap of the contact device according to the invention are preferably made of injection-molded insulation material, while the electrical contact elements are punched out of electrically conducting sheet material. The present invention thus provides a simple and inexpensive means for terminating coaxial cable on a large scale.

DETAILED DESCRIPTION OF THE INVENTION

Figure 1:
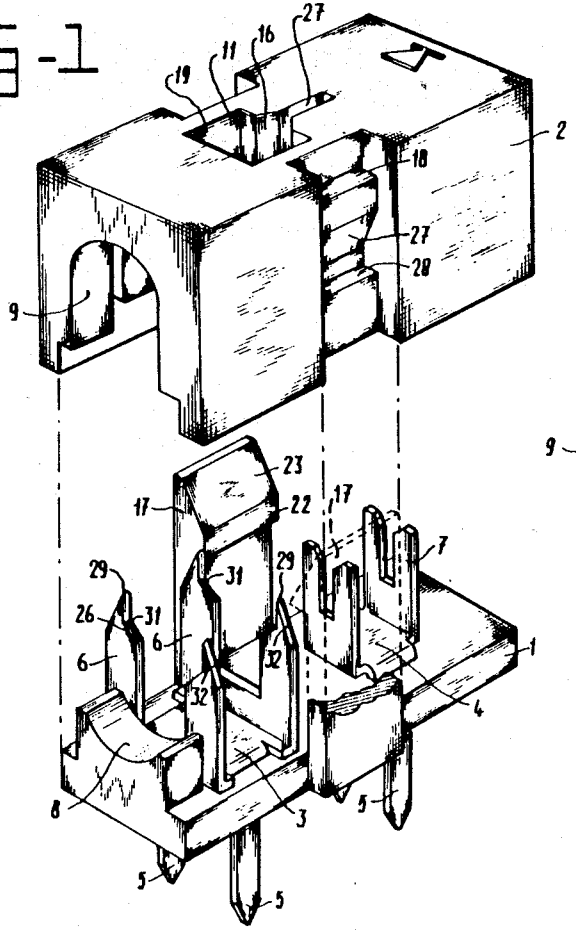
FIG. 1 is an exploded perspective view of one embodiment of a connector according to the invention.
Figure 8:
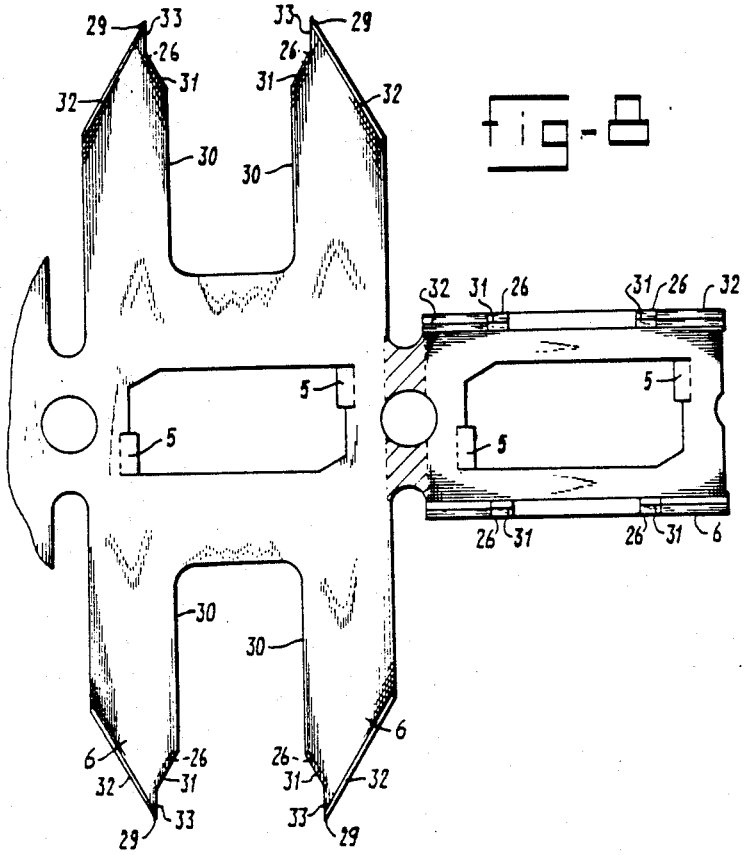
FIG. 8 shows a punched contact element which is manufactured from a piece of electrical sheet material and which may be used in the connector according to the invention.

FIG. 1 shows a preferred embodiment of the connector according to the present invention which includes a bottom plate 1 of insulating material in which is mounted a first contact element 3 and a second displaced contact element 4, both punched from electrically conducting sheet material such as shown in FIG. 8. The two contact elements 3 and 4 are provided with bent-over flat pins 5 projecting downwards through the bottom plate 1. These pins may make electrical contact with, for example, a printed circuit board by inserting the pins through the openings in the board and then soldered therein. The contact elements 3 and 5 may also be manufactured by a method other than being punched from sheet metal.

The contact element 3 is shaped as a double push-on contact with parts 6 projecting above the bottom insulating plate 1 as two twin parallel push-on contacts, shaped like fork-like teeth, which are joined to each other by a bottom part. Each push-on contact is provided in a known manner with a slot between the two teeth of a fork, which slot may have cutting edges for cutting through the insulation material. The same may apply to the second contact element 4. The cutting edges, which face inwards of the push-on contacts, will when a cable 20 (see FIGS. 3–7) is pushed into and between the push-on contacts, of the first contact element 3, penetrate through the optional outer cable sheath and electrically contact the outer conductor of the coaxial cable. The push-on contacts of the second contact element 4 will penetrate through the insulating inner sheath to the extent that the latter has not been removed, until contact is made with the core of the inner conductor. The cutting edges may dig into the material of the conductors.

Figure 2:
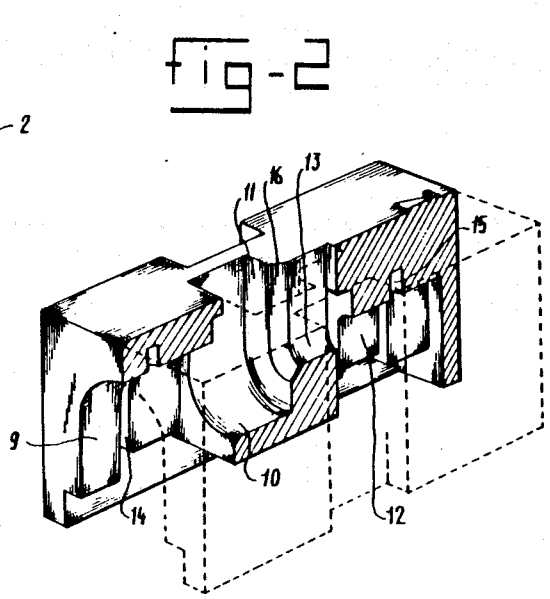
FIG. 2 is a perspective view showing in partial cross-section of the cap according to the invention provided with receiving spaces for the prepared cable.

A cap 2 is shown in partial cross-section in FIG. 2. The specially formed receiving spaces in the cap 2 for the various parts of the prepared cable end 20 are indicated by the reference numerals 9, 10, 11, 12 and 13. After the insulating outer sheath and inner sheath and also the outer conductor of the cable have been removed or stripped in a special manner over a length calculated from the cable end, this cable end is slid from the left side in FIGS. 1 and 2 into and through the aforenoted spaces of the cap 2. The bare inner conductor is then confined in the space 12 and is supported on the one hand by the top face of the space 12 which is open downwards, and on the other hand by the face 13 on which the conductor comes to rest. The remaining section of the cable end is supported by faces 9 and 10. The transversely cut-off end of the insulating outer sheath and the outer conductor push against a transverse face 11 which extends into the window 19, which is itself in turn the prolongation of a space having a support surface 10. Furthermore, there is located between the transverse face 11 and the spaces 12 and 13 in front of the bare conductor a beveled face 16 which serves to guide the inner conductor of the coaxial cable, whether still insulated or not, towards the spaces and the contact element for the inner conductor.

The cap further includes slots 14 and 15 which extend from below past the spaces 9, 10 and 12, respectively. These slots serve to receive the flat push-on twin contacts of contact elements 3 and 4. These slots are of the same width as the contacts, so that each contact is supported laterally when the coaxial cable is inserted.

The specially shaped opening 19 in the cap 2 provides the aforenoted window through which the correct position of the cable in the various spaces of the cap can be readily inspected from outside.

When the cable end has been placed in the cap 2, the cap is pressed down on to the bottom insulation plate 1. At the same time, the flat forked parts 6 slide into the slots 14 and 15, and the stripped cable end sections slide between the push-on contacts.

As the cap 2 is pressed downwards onto the bottom plate 1 and the cable end is pressed into the push-on contacts, the cable end can easily be held confined in the cap 2 in the preassembled position. This ensures that the outer conductor will make good electrical contact with the first contact element 3 and the inner conductor will make good electrical contact with the second contact element 4. All this can be observed via the window 19. Whether in the final position of the connection the cable still occupies the correct position and that no undesired connections have occurred between the inner conductor and the outer conductor and their respective contact elements is also observable through window 19 as is whether the cable has been damaged during placement of the cap.

On either side of the bottom plate 1 are lug-shaped locking elements 17 which project upwards opposite each other. The locking elements or lugs 17 are preferably formed integrally with the insulating material of the plate 1. These lugs 17 are also provided with protuberances 22 at their upper end which project inward. Each protuberance 22 also has an upwardly beleveled p art 23. As the cap 2 is pushed down onto the bottom plate 1, the lugs 17 are pushed apart by faces formed in slots on opposite outer sides of the cap adapted to receive the lugs 17.

Figure 5:
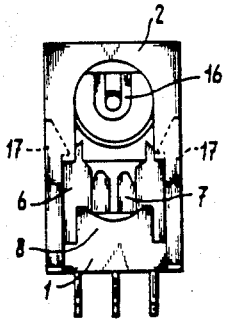
FIG. 5 is a front view of the connector of FIG. 1 in a preassembled position before the cap is fully pressed onto the bottom plate.
Figure 6:
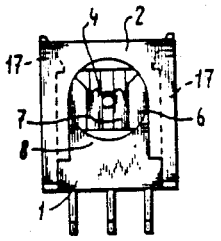
FIG. 6 is a front view according to FIG. 5 with the cap fully pressed onto the bottom plate.

After the cap 2 has been fully pressed downwards, the protuberances 22 of the lugs 17 engage behind faces 18 formed in the slots on the opposite outer sides of the cap. As shown in FIG. 1, the cap 2 includes a transverse face 28 and a sloping face 27 in the receiving slot for the lug 17. These match the beveled shape of the protuberance 22 of the lug 17. By this means, the cap 2 can be secured in a preassembled position on the bottom plate 1, as shown in FIGS. 5 and 6. In the preassembled position, the contact elements 3 and 4 are not yet located in their intended spaces within the cap, thus enabling the cable end to be easily slid in. After the cable is inserted, the cap 2 is pressed further onto the bottom plate 1, and electrical contact with the contact elements are established. In the preassembled position, the cap 2 can be stored and dispatched with the bottom plate 1.

Figure 3:
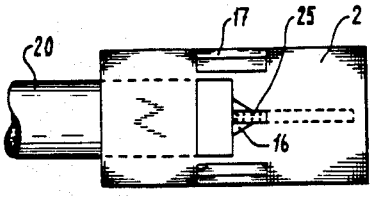
FIG. 3 is a plan view of the connector of FIG. 1 showing the cable with its prepared end in the connector.

In the plan view of FIG. 3, the shape of the cable end 20 is shown after stripping or other preparation, and after this end has been slid into the cap 2 up to its end position. The solid lines show the part of the cable 20 which is located outside the cap 2 and also which is visible through the window 19 from outside of the cap 2. As is shown, the inner sheath, between the outer conductor and the inner conductor, is cut off straight according to conventional stripping techniques up to the bare inner conductor 25, or to a separate insulating sheath which may surround conductor 25.

Figure 4:
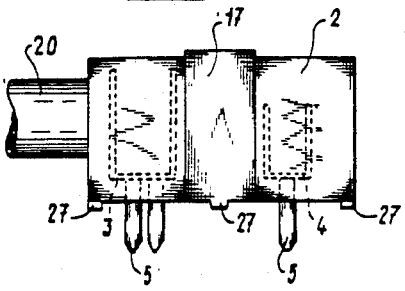
FIG. 4 is a side view of the connector of FIG. 1 showing the contact elements drawn in a dotted line.

FIG. 4 is a side view of FIG. 3 showing the contact elements. The bottom plate 1 is now completely inside the cap construction which in this case is provided with locating feet 27. The broken lines indicate the contact elements 3 and 4 in side view.

FIG. 5 shows the connector according to the invention in front view with the cap 2 in the preassembled position above the bottom plate 1. FIG. 6 is a similar view showing the cap 2 fully pushed onto the said bottom plate 1. The same reference numerals as in FIGS. 1 and 2 are used to indicate the same components.

Figure 7:
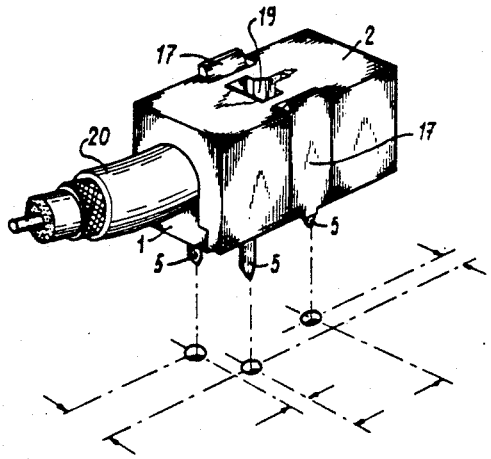
FIG. 7 is a perspective view of the connector according to the invention with the cable end fitted.

FIG. 7 shows in perspective the connector according to the invention after the cap 2 with the cable end 20 received therein has been placed on the bottom plate 1 and has been locked to the bottom plate 1 by means of the locking lugs 17. A number of connecting pins 5 project from the bottom side of the bottom plate 1. In this embodiment, the second contact element 4 has only one connecting pin. This can also be true for the first contact element 3.

The specific shape of one embodiment of the first contact element 3 is shown in FIG. 8 after the contact element has been punched out of sheet material. At the end of the flat, fork-shaped parts 6, there is stepwise reduction of the distance between the cutting knives with the parts 26 extending obliquely inwardly to enable stepwise cutting through of the insulating outer sheath of the coaxial cable. Preferably, the sharp cutting edges or knifes 29 are located at the top of each tooth transverse to the plane of the drawing. Cutting edges 29 make a first incision in the external insulating sheath. At the innersides, a flat portion 33 joins these cutting edges 29. The flat portion 33 then merges into the sloping inwardly extending part 26. The insulating sheath is thus further cut through by the sloping part 26 which has a cutting edge 31 and the sloping outer portion with its cutting edge 32, both of which are constructed as a knife with a roof-shape central cutting edge or a side cutting edge. Surface 30 adjoining the aforenoted parts has no sharp cutting edge because it comes into contact with the electrically conducting sheath which must not be cut through. Surface 30 may be a flat surface parallel to the insertion direction of the cable. The flat surface is suitable for electrically contacting the outer conductor. Other types and shapes of cutting edges may also be used. Also, the cutting edge 31 may be omitted.

In the plan view of FIG. 8, the connecting pins 5 in the central part are already bent over downwards and extend down from the plane of the drawing. On the right side of FIG. 8 forked parts 6 are showed bent over and upwards, in an upright position.

Figure 9:
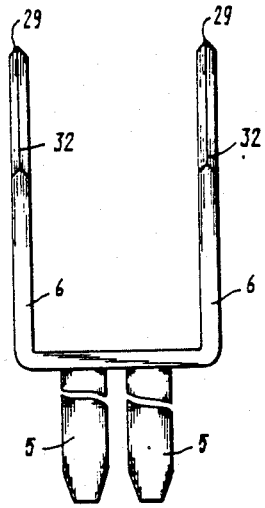
FIG. 9 shows a contact element in side view.

Finally, FIG. 9 shows a side view of the right side of FIG. 8 with the forked parts 6 bent upward. The second contact element 4 for the coaxial cable core can be manufactured in a similar manner. In the embodiment shown, the second contact element 4 is not shown with stepwise narrowing of the cutting slot nor with cutting edges 31, for example.

It should be understood that different variations of this preferred embodiment are possible, for example, by modifying the receiving spaces 12, 13, 9, etc. in the cap 2. As already stated, the second contact element 4 can also be constructed as a push-on contact which cuts through insulation, as a result of which the insulating inner sheath of the coaxial cable does not have to be completely removed during the preparation of the cable end.

Instead of a coaxial cable having only one inner conductor and an outer conductor coaxially disposed about it, the connector according to the present invention can also be used for a screened cable with more than one inner conductor such as, for example, a screened cable with two separate inner conductors. In that case, for example, two further contact elements such as element 4 may be used which are either set up behind each other or mutually displaced somewhat transversely to the insertion direction of the end with respect to each other. The conductor can thereby be led alongside the second contact element situated at the front side as seen from the insertion direction to the additional contact elements situated somehwat more to the rear. These additional contact elements can also be set up next to each other. One of the important advantages of the invention, viz., the clamping of the outer sheath in the space 9 and the surface 8 as shown in FIG. 1 is thereby retained, thus providing very good pull or strain relief while the cap 2 may be provided with receiving spaces for the additional inner conductors. The spaces 9, 10, 11, 16, 13 and 12 are not restricted to the dimension and sequences as shown but can be matched to different stripped ends. In the figures, the embodiments show but one preferred stripping technique that can be used.

It should therefore be understood that the forms of the invention shown and described herein are but preferred embodiments and that various changes may be made without departing from the spirit and scope of the invention.

I claim:

1. A connector for a coaxial cable with at least one inner conductor and at least one outer conductor, insultated from said inner conductor by a inner sheath of insulating material, said connector comprising:

a bottom plate of insulating material, first and second contact elements mounted on said plate, said first and second contact elements being electrically separated and extending parallel to one another upwardly from and perpendicular to said bottom plate, each said first and second contact element also including at one end at least one pin which projects downward through the bottom of said plate.

a first push-on contact means formed at the other end of said first contact element extending upward from the bottom plate, said first push-on contact means adapted to penetrate any insulation material which may surround the outer conductor of the cable and to make electrical contact with said outer conductor, a second push-in contact means formed at the other end of said second contact element extending upward from the bottom plate, said second push-on contact means adapted to penetrate said inner sheath and to make electrical contact with said inner conductor;

a cap for connection to the bottom plate provided with specially formed inner spaces, said cap including at one end an insertion opening for inserting the coaxial cable into the cap and, in the direction of insertion, a plurality of spaces having internal dimension decreasing successively from said opening and corresponding to the outer dimensions of the end of the coaxial cable which has been stripped in preparation for insertion into the connector, each said space providing at least partial support for the cable end portion received therein when the cap is connected to the bottom plate, and slots formed in said cap which extend through certain ones of said spaces and which are adapted to receive the upwardly extending push-on contact means of the first and second contact elements when the cap is connected to the bottom plate, thereby causing the push-on contact means to penetrate through said certain ones of said spaces.

2. A connector according to claim 1 in which a first of said spaces in the cap is adapted to receive a first portion of the end of the cable having said insulation material surrounding the outer conductor, said first space being open on the side facing the bottom plate, said bottom plate being provided with an upright part with an upper surface matching the outer contour of said first cable end portion and which fits slidingly into said first space, whereby when the cap is connected to the bottom plate, said first space will circumferentially support said first cable end portion.

3. A connector according to claim 1 wherein the cap is provided with at least one window which opens a portion of one or more of said spaces in the cap to the outside.

4. A connector according to claim1 wherein the bottom plate is provided with two resilient locking lugs which project upwards opposite each other from respective side edges of the bottom plate, each said lug being provided at its free top end with a portion projecting inwards towards the corresponding portion of the other lug, said cap further being provided with outer surfaces on opposite sides adapted to sequentially engage the inwardly projecting portions of each lug as the cap is pushed onto the bottom plate.

5. A connector according to claim 1 wherein the slots in the cap for receiving first and second contact elements are dimensioned to support the first and second contact elements on all sides.

6. A connector according to claim 5 wherein the width of the slots transverse to the insertion direction is equal to the width of said first and second contact elements.

7. A connector according to claim 1 wherein said first contact means includes a pair of parallel push-on contacts with fork-like teeth which, when viewed in the insertion direction, are sequentially provided with a sharp transverse knife edge at the top of each tooth for cutting into the insulation material surrounding the outer conductor and further including at least one sloping cutting edge for further cutting through said insulation material and a flat surface parallel to the insertion direction of the cable which makes contact with the outer conductor, whereby a stepwise cutting through said cable insulation material is obtained.

8. A connector according to claim 7 wherein said sloping cutting edge extends outwards from the sharp transverse knife edge at top of each tooth.

9. A connector according to claim 7 wherein said sloping cutting edge extends inwardly from said sharp knife edge, and disposed between said sharp knife edge and said inwardly sloping cutting edge is a second flat surface facing inwardly, said second flat surface being parallel to the insertion direction of the cable.

* * * * *